US005366144A

United States Patent [19]

Eisman

[11] Patent Number: 5,366,144

[45] Date of Patent: Nov. 22, 1994

[54] INTERNAL SUPPORT FOR CARTONS

[75] Inventor: Larry Eisman, Elkins Park, Pa.

[73] Assignee: Dopaco, Inc., Downingtown, Pa.

[21] Appl. No.: 200,523

[22] Filed: Feb. 23, 1994

[51] Int. Cl.[5] ..... B65D 5/42

[52] U.S. Cl. ..... 229/199; 426/124

[58] Field of Search ..... 229/199, 120.38; 426/128, 124; 206/551, 45.32, 521

[56] References Cited

U.S. PATENT DOCUMENTS

| | | | |
|---|---|---|---|
| 655,939 | 8/1900 | Overton . | |
| 886,462 | 5/1908 | Amos | 229/199 X |
| 1,885,906 | 11/1932 | Gallistel | 229/199 X |
| 2,229,395 | 1/1941 | Stock | 229/199 X |
| 2,525,337 | 10/1950 | Brooks et al. | 206/551 |
| 2,749,011 | 6/1956 | Lebow | 229/120.38 X |
| 3,180,739 | 4/1965 | Stoker . | |
| 3,637,404 | 1/1972 | MacManus . | |
| 3,946,935 | 3/1976 | Bonczyk | 229/199 |
| 4,141,447 | 2/1979 | Anderson . | |
| 4,498,586 | 2/1985 | Vitale . | |
| 4,700,843 | 10/1987 | Cohen . | |
| 4,765,534 | 8/1988 | Zion . | |
| 4,826,016 | 5/1989 | Foster | 229/120.38 |
| 4,877,609 | 10/1989 | Beck et al. | 426/128 X |
| 4,913,340 | 4/1990 | Ilitch . | |
| 5,077,050 | 12/1991 | Wall | 426/128 X |
| 5,082,677 | 1/1992 | Bear . | |
| 5,217,774 | 6/1993 | Finrow | 229/199 X |

FOREIGN PATENT DOCUMENTS 2530584 7/1982 France .

*Primary Examiner*—Allan N. Shoap
*Assistant Examiner*—Christopher McDonald
*Attorney, Agent, or Firm*—Dennison, Meserole Pollack and Scheiner

[57] ABSTRACT

A carton support formed from a folded unitary blank of paperboard and including a central member with a pair of separate side members mounted to the same end of said central member and outwardly pivoted to generally overlie the opposite sides of the central member and extend at acute angles to the respective sides thereof. A pair of lugs, one on each side member, snap-lock into position to retain the side members in their erected positions at acute angles to the central member.

23 Claims, 2 Drawing Sheets

INTERNAL SUPPORT FOR CARTONS

BACKGROUND OF THE INVENTION

Many cartons, particularly those associated with take-out foods, are formed of relatively thin material wherein the lid is of a substantial unsupported expanse and tends to sag and contact the contents of the box to the detriment of the contents.

A well known example of such a carton, and the problems caused by a tendency of the lid to centrally sag, is the conventional pizza box. Similar problems will also be noted in folded paperboard containers for cakes, pies and the like, particularly when the containers are stacked.

In order to avoid or minimize this problem, various forms of internal supports have been devised, including plastic spacers which are relatively expensive for a throwaway item. Another solution provides for a tear-away section of the carton which is subsequently formed into a spacer for insertion within the carton, a rather complex and time consuming procedure which could in fact damage the carton if not properly done. An additional proposal involves the use of tabs folded from the carton itself. This, particularly if folded from the top or bottom of the carton, could further weaken the carton at the critical area, as well as provide undesirable openings into the interior of the carton. Other solutions involve the use of various forms of preform supports which are not only bulky, causing shipping and storage expenses, but also must, at some point, be inserted in the individual cartons or boxes.

SUMMARY OF THE INVENTION

The present invention is an internal support for pizza cartons and the like, and is constructed of inexpensive and readily folded shape sustaining material. The support, mounted preferably to the undersurface of the carton or box lid, lies flat thereagainst prior to use to avoid interfering with either the stored stacking of formed cartons or the stacking of the carton blanks prior to folding. The support also lends itself to mounting to the carton at substantially any stage from the initial formation of the carton to just prior to a closing of the carton with the contents therein.

From its stored position, the support is easily erected and automatically maintains itself in a support position.

The internal support is formed from a blank or unitary piece of foldable paperboard or the like which has sufficient rigidity as to be capable of maintaining the erected configuration of the support formed therefrom.

The blank, or unitary piece, is folded to define a central member formed of two substantially equal, adhesively secured panels. Each of the central member panels at an end thereof common with a similar end on the other central member panel, mounts, through an integral fold line, a side member or panel. A glue flap or mounting flange is integrally formed with an inner or lower edge of one of the central member panels with a fold line defined therebetween. The glue flap is affixed to the inner surface of the carton lid with the central member and the side members parallel thereto and lying flat against the inner surface.

When the support is to be erected, the central member and the attached side panels are folded to project laterally from the mounted glue flap, after which the side members are swung outwardly from each other to a position engaging or substantially engaging the opposed panels of the central member. At this point, two small locking lugs, along the side panel fold lines, respectively resiliently flex with one bypassing the other to extend beyond the two fold lines where engagement of the lugs with each other limit the return movement of the side panels to acute angles with the respective sides of the central member, thus providing a spread three member support.

The exposed outer edges of the central and side members, remote from the glue flap, are centrally recessed to, upon engagement with the foodstuff itself if such is the case, provide adequate support with minimal damaging contact. Similarly, in order to facilitate opening of the side members or panels relative to each other, a portion of one side panel projects beyond the other side panel for easy manual access thereto.

With the side members in the support position, it will be appreciated that the central member cannot, without manual manipulation, be folded flat. However, should it become desirable to collapse the support, the side members can be manually moved from their locked position with the locking lugs flexibly bypassing each other and allowing return of the panels to their parallel adjacent position which in turn will allow a downward lateral folding of the central member to substantially parallel the mounted flange or glue flap.

Other features and advantages of the invention will become apparent from the more detailed description of the invention following hereinafter.

DESCRIPTION OF PREFERRED EMBODIMENT

Figure 1:
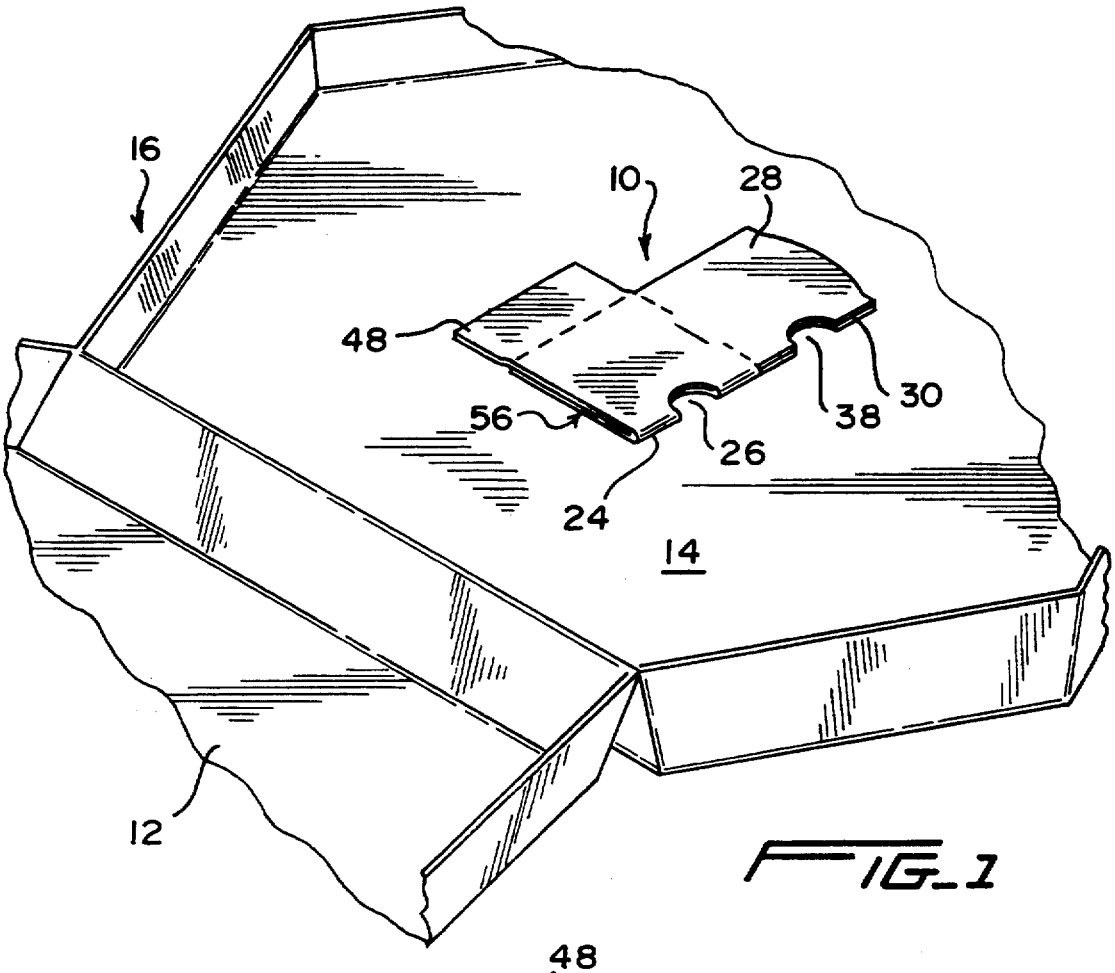
FIG. 1 is a perspective view of a portion of an open pizza box with the internal support of the invention mounted to the undersurface of the cover.

Referring now more specifically to the drawings, the support 10 of the invention is intended to mount between a base 12 and an overlying cover or covering member 14 to define a lateral support therebetween. While not limited thereto, its most common anticipated use will be within a pizza box or carton 16. In such case the support will mount, usually centrally, to the undersurface of the cover or top 14 and, upon a closing of the cover over the base 12, bear in a non-damaging manner on the pizza itself. The rather large area of the flexible cover 14 will thus be maintained out of contact with the upper face of the pizza, even should several filled boxes be stacked. Depending on the carton contents, the support can extend upward from the base.

The support 10 is formed from a foldable blank 18 of paperboard of sufficient rigidity to maintain itself in the erected position to be described subsequently. While other materials may be used, the substantial advantages of paperboard or cardboard with regard to availability, ease of handling, low cost, and the like, make it the preferred material.

The blank 18 includes two equal or substantially equal size rectangular main panels 20 and 22 integrally joined along common edges thereof by a fold line 24. A circular opening 26 is formed centrally along the fold line 24 and extends equally into each of the panels 20 and 22.

A pair of side members or panels 28 and 30 are of generally equal size to the panels 20 and 22 and integrally joined thereto along one end thereof, panel 28 adjacent panel 20 with fold line 32 defined therebetween, and panel 30 adjacent panel 22 with fold line 34 defined therebetween. A cut line 36, which comprises a longitudinal extension of the fold line 24, divides the panels 28 and 34 for independent movement. The cut line has an opening 38 centrally thereof which duplicates the opening 26 and similarly extends equally into the opposed panels 28 and 30.

Each of the fold lines 32 and 34, for a central elongate portion thereof, is defined by a cut line 40 which extends or is laterally offset into the respective panels 20 and 22 in order to define a pair of elongate relatively narrow lugs 42, one coplanar with each of the panels 28 and 30 and foldable therewith about the respective fold line which extends to each side of this central lug 42.

The outer end 44 of the panel 28, opposed to the fold line 32 and generally parallel thereto, includes an elongate outwardly directed convex portion. The corresponding outer end 46 of the panel 30 includes an elongate equally dimensioned outwardly directed concave portion. These outer ends 44 and 46 are differently configured to allow easy access thereto in the formed support ]0 as shall be explained. The corresponding nature of the convex and concave portions is desired to facilitate the formation of adjacent duplicate blanks, one inverted relative to the other, with minimal waste.

A mounting flange or glue flap 48 is integral with the outer edge of panel 20 opposed from and parallel to the central fold line 24, with a fold line 50 defined between flap 48 and panel 20. The flap 48 is preferably of equal length with the side edge of the panel 20 and of a substantially shorter width outward therefrom.

Figure 2:
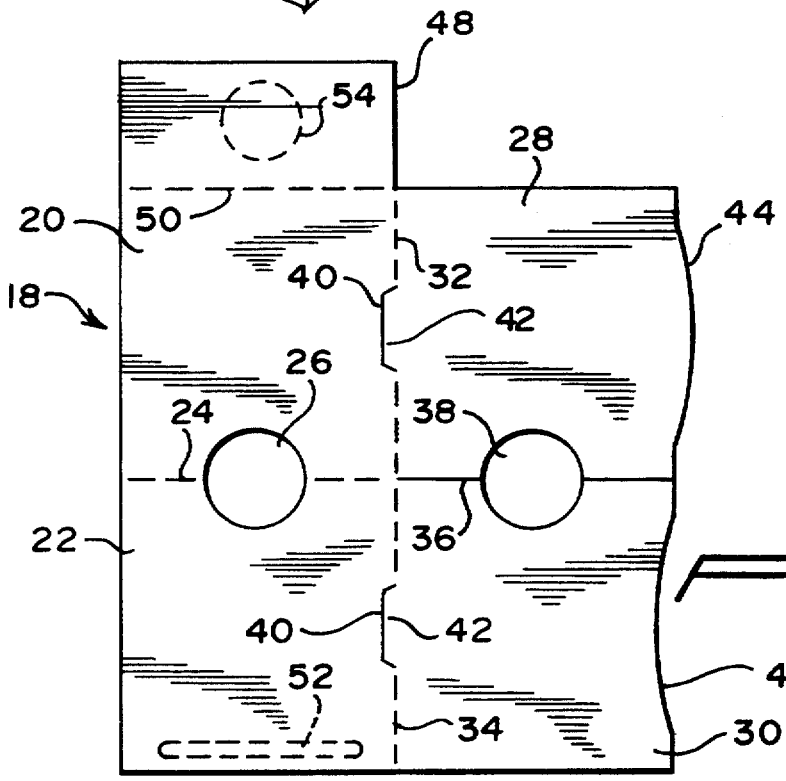
FIG. 2 is a plan view of the blank from which the support is formed.

In forming the support 10, the panels 22 and 30 are folded to overlie the respective panels 20 and 28, either thereabove or therebelow, about the fold line 24 and linearly aligned cutline 36. The overlying panels 20 and 22 are secured along a substantial portion of the edges thereof remote from the fold line 24 by appropriate means such as the adhesive strip 52 suggested in FIG. 2.

Upon a positioning of the folded support 10 on, as suggested in FIG. 1, the undersurface of a carton lid, the mounting flange 48 is fixed to the lid, preferably by an appropriate adhesive or the like 54. The support 10 may be retained in the flat position thereof as in FIG. 1 until such time as the contents of the box or carton are introduced and the cover is to be closed thereon. This flat positioning facilitates a nested stacking of multiple open boxes, or a stacking of box blanks prior to a folding thereof, for ease in handling, shipping and storage.

When the mounted support 10 is to be erected, the overlying panels 20 and 22 are pivoted upward or laterally about the fold line 50 to define a central member 56 comprised of the two panels 20 and 22. The overlying panels 28 and 30 similarly pivot laterally therewith and are positioned to define side panels or members in the completely erected support. This first step is noted in FIG. 3. Turning now to FIG. 4, the next step involves an outward swinging of the side panels 28 and 30, about the respective fold lines 32 and 34, relative to each other and to respectively overlie the central member panels 20 and 22.

At this step, the side panels 28 and 30 are preferably pivoted substantially a full 180 degrees to engage against the central member panels 20 and 22, the purpose of this being to allow for a movement of the now-aligned lugs 42 past each other so as to project beyond the ends of the central member 56 and side members or panels 28 and 30 defined by the fold lines 32 and 34. In this intermediate position, the lugs 42 are in immediate adjacent parallel relation to each other. Incidentally, it should be appreciated that the outward swinging of the side panels 28 and 30 relative to each other is facilitated by the easily grasped ends thereof which correspond to the blank edges 44 and 46.

The lugs 42, upon an outward swinging of the panels 28 and 30, snap into the position of FIG. 4 due to the inherent resilient flexibility of the material thereof with, if necessary, a slight flexing in the adjoining ends of the central member panels 20 and 22 along the fold lines 32 and 34.

Figure 3:
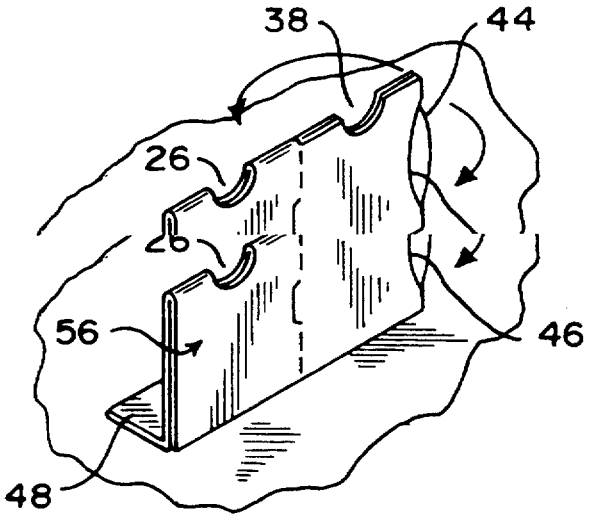
FIG. 3 illustrates the initial step in erecting the support.
Figure 4:
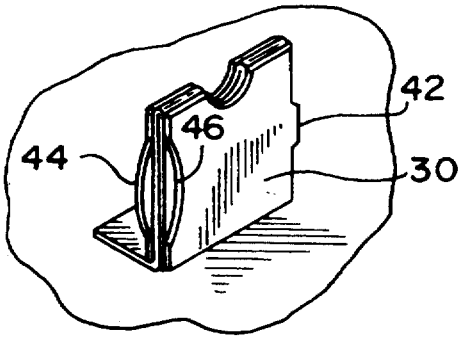
FIG. 4 illustrates the final manual step in erecting the support.
Figure 5:
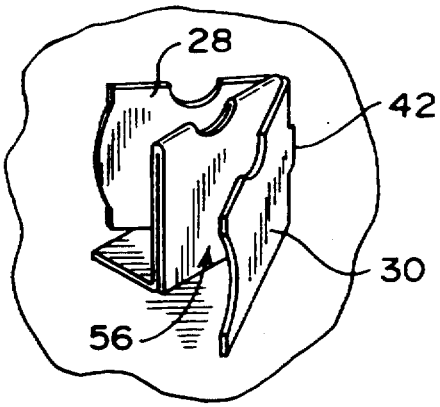
FIG. 5 illustrates the support in its automatically assumed final position.
Figure 6:
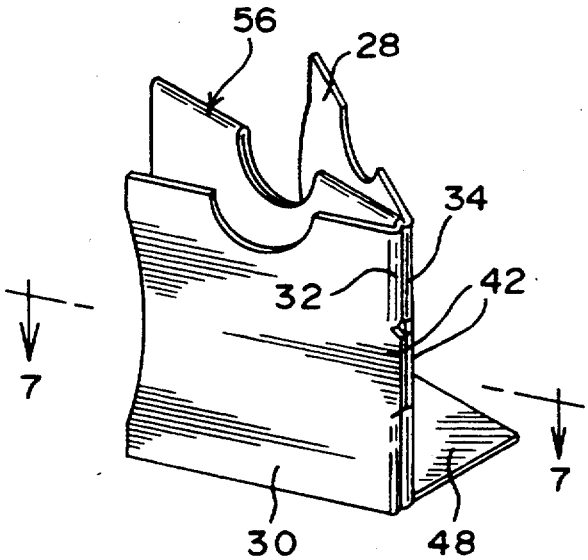
FIG. 6 is an enlarged perspective view of the support rotated approximately 90 degrees from the position of FIG. 5 and illustrating the apex ends of the diverging side members.
Figure 7:
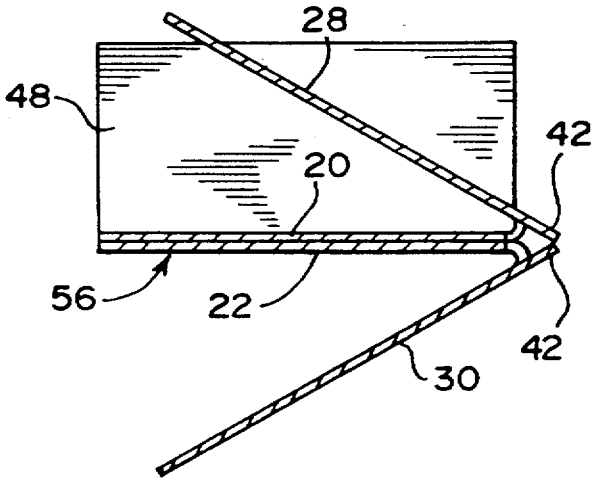
FIG. 7 is an enlarged cross-sectional view taken substantially on a plane passing along line 7-7 in FIG. 6.
Figure 3:
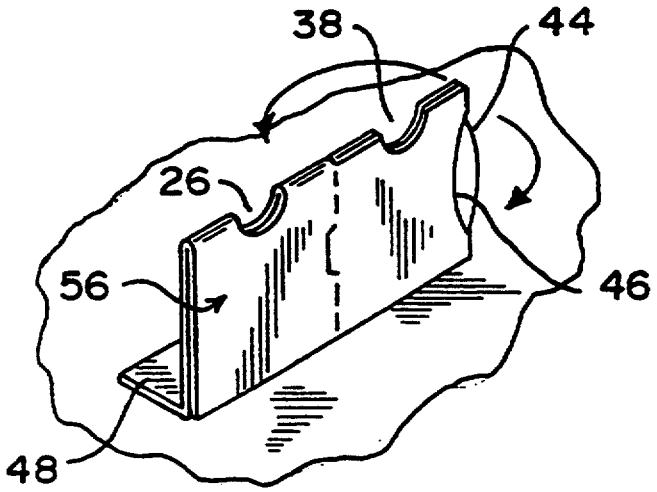

Noting FIGS. 5, 6 and 7, upon a release of the folded panels 28 and 30, in the intermediate position of FIG. 4, these side panels, due to the inherent memory characteristics of the material, outwardly swing toward their original planar position as in FIG. 3. However, the now reversely turned lugs 42 effectively abut each other and prevent a movement of the side panels 28 and 30 beyond an acute angle with respect to the central member, thus stabilizing the support in its erected or support position and providing three diverging support members extending from a vertex end. In this manner a relatively wide support area is provided in conjunction with a wide base area to prevent lateral tipping or folding of the support once erected,. It should be appreciated from FIG. 7 in particular, that while the lugs 42 can be manually reinverted to the position of FIG. 3, this will not occur automatically or without positive external force, thus ensuring a rigid spread support notwithstanding the rather thin nature of the paperboard from which the support is constructed.

It will be noted that the previously described circular openings 26 and 38 in the blank 18, upon a folding about the fold line 24 and cut line 36, define central recessed areas in the upper or outer edges of the central member 56 and side members 28 and 30, thereby reducing the area of contact with foodstuffs or the like as may be in the carton without affecting the stability of the support.

The foregoing described embodiment is illustrative of the principals of the invention. As other embodiments incorporating the inventive features may occur to those skilled in the art, the disclosed embodiment is not to be considered as a limitation on the scope of the invention. Rather, the invention is only to be limited by the scope of the claims following hereinafter.

I claim:

1. A carton support for the stabilization of an overlying top member relative to a base; said support being adapted to extend substantially perpendicular to and between said base and overlying top member and comprising a central member with opposed sides, said central member having opposed first and second edges, said central member having opposed first and second ends extending between said edges, first and second side members, each side member having opposed edges, each side member having one of said ends thereof adjacent said first end of said central member, said side members, in a support position, being outward of the opposed sides of said central member and extending at an angle thereto from said first end of said central member, means on said first edge of said central member adapted for engaging and securing said first edge of said central member to one of said top member and said base for extension of said central member substantially perpendicular thereto, the height of each side member between said opposed edges thereof being substantially equal to the height of said central member between said first and second edges thereof, each side member, at said end adjacent said first end of said central member, being foldably joined to said central member for pivotal movement between a first closed position, wherein said side members overlie each other and extend outward from said central member substantially parallel thereto, and said support position.

2. The support of claim 1 wherein the angle at which each side member, in said support position, extends from said central member is an acute angle.

3. The support of claim 2 wherein said means adapted for engaging and securing said first edge of said central member comprises a laterally extending flange on said first edge adapted to overlie said one of said top member and said base for fixing thereto.

4. The support of claim 3 wherein said first edge of said central member is foldably joined to said flange for selective pivoting between a stored position wherein said central member substantially parallels said flange and an erected position wherein said central member projects substantially perpendicular to said flange.

5. The support of claim 4 wherein said central member comprises a pair of substantially duplicate overlying panels, each of said side members being foldably joined to a different one of said central member panels.

6. The support of claim 5 including means for retaining said side members in said support position comprising a lug on each said side member on said end thereof adjacent said first end of said central member, each said lug being free of said central member and foldable with the corresponding side member to said support position, said lugs, in said support position of said side members, extending outward of said first end of said central member and interlocking with each other and precluding free movement of said side members from said support position.

7. The support of claim 6 wherein said central member panels are foldably joined along said second edge of said central member.

8. The support of claim 7 wherein said support comprises a folded unitary blank of shape-sustaining material.

9. The support of claim 8 wherein in said closed position said first side member, at an end remote from said first end of said central member, is recessed to laterally expose a portion of the said second side member for access thereto to move said side members to said support position.

10. A carton support for the stabilization of an overlying top member relative to a base; said support being adapted to extend substantially perpendicular to and between said base and overlying top member and comprising a central member with opposed sides, said central member having opposed first and second edges, said central member having opposed first and second ends extending between said edges, first and second side members, each side member having opposed edges and opposed ends extending between said side member edges, each side member having one of said ends thereof adjacent said first end of said central member, said side members, in a support position, being outward of the opposed sides of said central member and extending at an angle thereto from said first end of said central member, means on said first edge of said central member adapted for engaging and securing said first edge of said central member to one of said top member and said base for extension of said central member substantially perpendicular thereto, the height of each side member between said opposed edges thereof being substantially equal to the height of said central member between said first and second edges thereof, said second edge of said central member and the corresponding edge of each side member each having an inwardly relieved portion centrally therealong.

11. A carton support for the stabilization of an overlying top member relative to a base; said support being adapted to extend substantially perpendicular to and between said base and overlying top member and comprising a central member with opposed sides, said central member having opposed first and second edges, said central member having opposed first and second ends extending between said edges, first and second side member, each side member having opposed edges and opposed ends extending between said side member edges, each side member having one of said ends thereof adjacent said first end of said central member, said side members, in a support position, being outward of the opposed sides of said central member and extending at an angle thereto from said first end of said central member, means on said first edge of said central member adapted for engaging and securing said first edge of said central member to one of said top member and said base for extension of said central member substantially perpendicular thereto, said means adapted for engaging and securing said first edge of said central member comprises a laterally extending flange on said first edge adapted to overlie said one of said top member and said base for fixing thereto.

12. The support of claim 11 wherein said first edge of said central member is foldably joined to said flange for selective pivoting between a stored position wherein said central member substantially parallels said flange and an erected position wherein said central member projects substantially perpendicular to said flange.

13. A carton support for the stabilization of an overlying top member relative to a base; said support being adapted to extend substantially perpendicular to and between said base and overlying top member and comprising a central member with opposed sides, said central member having opposed first and second edges, said central member having opposed first and second ends extending between said edges, first and second side members, each side member having opposed edges and opposed ends extending between said side member edges, each side member having one of said ends thereof adjacent said first end of said central member, said side members, in a support position, being outward of the opposed sides of said central member and extending at an angle thereto from said first end of said central member, each side member, at said end adjacent said first end of said central member, being foldably joined to said central member for pivotal movement between a first closed position, wherein said side members overlie each other and extend outward from said central member substantially parallel thereto, and said support position.

14. The support of claim 13 wherein said central member comprises a pair of substantially duplicate overlying panels, each of said side members being foldably joined to a different one of said central member panels.

15. The support of claim 14 wherein said support comprises a folded unitary blank of shape-sustaining material.

16. The support of claim 15 wherein, in said blank, said central member panels are coplanar and integrally joined along a common edge with a fold line defined therealong, said common edge defining said second edge of said central member, each side member comprising a panel integral with and coplanar with a separate one of said central member panels along an end thereof corresponding to said first end of said central member and with a fold line defined therealong, a cut line defined between said side member panels, said cut line comprising a linear continuation of said fold line at said common edge of said central member panels, one of said side member panels having a portion thereof extending outward, relative to the corresponding central member panel, a greater distance than a corresponding portion of the other of said side member panels, each side member panel, along the fold line between the side member panel and the corresponding central member panel, having a coplanar integral lug extending partially into the central member panel and defined by a cut line for folding of said lug with the side member panel.

17. The support of claim 14 wherein said central member panels are foldably joined along said second edge of said central member.

18. The support of claim 13 wherein the angle at which each side member, in said support position, extends from said central member is an acute angle.

19. The support of claim 13 wherein in said closed position, said first side member, at an end remote from said first end of said central member, is recessed to laterally expose a portion of the said second side member for access thereto to move said side members to said support position.

20. A carton support for the stabilization of an overlying top member relative to a base; said support being adapted to extend substantially perpendicular to and between said base and overlying top member and comprising a central member with opposed sides, said central member having opposed first and second edges, said central member having opposed first and second ends extending between said edges, first and second side members, each side member having opposed edges and opposed ends extending between said side member edges, each side member having one of said ends thereof adjacent said first end of said central member, said side members, in a support position, being outward of the opposed sides of said central member and extending at an angle thereto from said first end of said central member, and means for retaining said side members in said support position comprising a lug on each said side member on said end thereof adjacent said first end of said central member, each said lug being free of said central member and foldable with the corresponding side member to said support position, said lugs, in said support position of said side members, extending outward of said first end of said central member and interlocking with each other and precluding free movement of said side members from said support position.

21. A carton support for the stabilization of an overlying top member relative to a base; said support being adapted to extend substantially perpendicular to and between said base and overlying top member and comprising a central member with opposed sides, said central member having opposed top and base edge portions, said central member having opposed first and second end portions extending between said edge portions, at least one side member, said at least one side member having opposed edge portions and opposed end portions extending between said edge portions of said at least one side member, said at least one side member having one of said end portions thereof adjacent said first end portion of said central member, said at least one side member, in a support position, extending at an acute angle from said first end portion of said central member laterally of one of said sides of said central member, the height of said at least one said member between said opposed edge portions thereof being substantially equal to the height of said central member between said top and base edge portions thereof, said at least one side member, at said end portion thereof adjacent said first end portion of said central member, being foldably joined to said central member for pivotal movement between a first closed position, wherein said at least one side member extends outward from said central member substantially coplanar therewith, and said support position.

22. The support of claim 21 wherein said base edge portion of said central member and the corresponding edge portion of said at least one side member each have an inwardly relieved area centrally thereof.

23. The support of claim 21 wherein said at least one side member includes two side members which, in the support position, extend at acute angles from said first end portion of said central member to said opposed sides of said central member, said two side members each having corresponding edge portions and end portions, means for retaining said side members in said support position comprising a lug on each said side member on said end portion thereof adjacent said first end portion of said central member, each said lug being free of said central member and foldable with the corresponding side member to said support position, said lugs, in said support position of said side members, extending outward of said first end portion of said central member and interlocking with each other and precluding free movement of said side members from said support position.

* * * * *

UNITED STATES PATENT AND TRADEMARK OFFICE

CERTIFICATE OF CORRECTION

PATENT NO. : 5,366,144

DATED : November 22, 1994

INVENTOR(S) : Larry Eisman

It is certified that error appears in the above-indentified patent and that said Letters Patent is hereby corrected as shown below:

Delete Fig 3 and replace with the attached

Column 5, line 1, after "opposed" insert --edges and opposed ends extending between said side member--.

Column 8, line 27, change "said" (second occurrence) to --side--.

Signed and Sealed this

Tenth Day of January, 1995

*Attest:*

*Attesting Officer*

BRUCE LEHMAN

*Commissioner of Patents and Trademarks*